US005449047A

United States Patent [19]

Schivley, Jr.

[11] Patent Number: 5,449,047

[45] Date of Patent: Sep. 12, 1995

[54] AUTOMATIC CONTROL OF DRILLING SYSTEM

[75] Inventor: George P. Schivley, Jr., Richardson, Tex.

[73] Assignee: Ingersoll-Rand Company, Woodcliff Lake, N.J.

[21] Appl. No.: 301,605

[22] Filed: Sep. 7, 1994

[51] Int. Cl.[6] ..... E21B 44/00

[52] U.S. Cl. ..... 175/27; 175/51; 173/6; 173/11

[58] Field of Search ..... 175/27, 38, 51; 173/6, 173/11; 408/9, 10, 11, 12

[56] References Cited

U.S. PATENT DOCUMENTS

| | | | |
|---|---|---|---|
| 4,195,699 | 4/1980 | Rogers et al. | 175/27 |
| 4,354,233 | 10/1982 | Zhukovsky et al. | 364/420 |
| 4,662,608 | 5/1987 | Ball | 175/27 |
| 4,721,172 | 1/1988 | Brett et al. | 175/26 |
| 4,793,421 | 12/1988 | Jasinski | 175/27 |
| 4,875,530 | 10/1989 | Frink et al. | 175/27 |
| 5,348,106 | 9/1994 | Mattero | 175/27 |
| 5,358,058 | 10/1994 | Edlund et al. | 175/27 |

*Primary Examiner*—Ramon S. Britts

*Assistant Examiner*—Frank S. Tsay

*Attorney, Agent, or Firm*—John J. Selko

[57] ABSTRACT

A blasthole drill is provided with sensors for sensing the pressure (AP) applied to and through a drill bit to convey cuttings from the drill hole, the rate of rotation (N) of the drill bit, the torque (RT) required to rotate the bit, the force (FB) applied axially to the bit and the instantaneous vertical position (Y) of the bit. Output signals from the sensors are applied to a microprocessor-based controller which computes the penetration of the drill bit per revolution of the bit (P/R) and the rock specific fracture energy (Es). Using the sensed values and the computed values, the controller produces output signals to increment/decrement the force (FB) applied axially to the drill. The applied axial force is controlled such that the penetration of the bit per revolution remains substantially constant for a given range of values of the rock specific fracture energy but varies for different ranges of the rock specific fracture energy. The rate of rotation of the drill bit is controlled to a reference value. Drill vibration sensors provide further input signals to the controller and when the vibration exceeds a predetermined limit the rate of bit rotation is immediately decreased.

9 Claims, 4 Drawing Sheets

AUTOMATIC CONTROL OF DRILLING SYSTEM

FIELD OF THE INVENTION

The present invention relates to control of drills of the type used to drill holes in earth formations. More particularly, the invention relates to a method and apparatus for controlling the axial force applied to a drill bit and the rate of rotation of the drill bit to obtain more efficient utilization of the bit with minimum vibration.

BACKGROUND OF THE INVENTION

The Rotary Drill Division of Ingersoll-Rand Company markets vehicle-carried blasthole drills used in the mining industry to drill holes into which blasting charges are inserted and set off to fracture rock formations. Typically, an operator relies on past experience to manually control the axial force applied to the drill bit and the rotational speed of the drill bit, the control being exercised by operation of manual controls provided in the operator's cab of the vehicle. The operator must continuously monitor the drilling operation, varying the rotational speed of the bit and the axial force applied to the bit as the bit moves through rock, less dense material and voids. The constant supervision results in operator fatigue. Furthermore, if the operator sets the rotation speed too high, vibration may be induced which could damage the drill. Also, in very soft material, applying too high an axial force could create such a volume of rock chips that the forced air removal system could not handle them and that could lead to plugging the air jets in the bit and result in interruption of the drilling process to clear the jets. In addition, an excessive axial force applied to the bit adversely affects the useful life of the bit.

Extensive field testing of rotary drills having tricone bits has shown that for a given type of rock the penetration of a bit, per revolution of the bit, is a unique function of the axially directed force applied to the bit and, for efficient utilization of the bit, the penetration of the bit per revolution (P/R) should not grossly exceed the height of the cutting elements of the bit. Tests further show that for a given axial force (FB), the absolute rate of advance of the bit into the formation is a unique function of the angular speed (N) of the bit. The limiting factor on how fast a bit can be rotated is the onset of drilling vibration. Finally, it has been observed that if the pressure in the forced air removal system rises above a normal operational value for a given drilling system, such rise is an indication that the advance of the bit per revolution of the bit is too high and plugging of the nozzles in the bit could occur.

Jasinski U.S. Pat. No. 4,793,421 discloses a control system wherein the axial force applied to a bit and the rotational speed of the bit are controlled at the maximum values possible without causing components and/or subsystem overloading to occur. This system does not control P/R to any reference value.

Zhulovsky et al. U.S. Pat. No. 4,354,233 discloses a control system for controlling P/R and the product (FB)(N), these values being referred to as Z and F/Z, respectively, in the patent. Z and F/Z are controlled so as to be as close as possible to values $Z_0$ and $(F/Z)_0$ that are continuously calculated by a microprocessor. $Z_0$ and $(F/Z)_0$ are presented as the optimum values for the drill to operate at for any given type of rock, based on various criteria built into the logic of the microprocessor. As the drill bit passes from one type of rock to another, the microprocessor calculates the appropriate values of $Z_0$ and $(F/Z)_0$ for Z and F/Z to be compared against. A two-step control sequence is employed. If something causes Z to not equal $Z_0$, a signal is sent to a rotation frequency regulator that in turn causes the bit rotation speed to change. This in turn causes F/Z to not equal $(F/Z)_0$ so a signal is sent to an axial load regulator to change the axial force applied to the bit.

From extensive field test data, it can be shown that P/R (Z in the reference) is in no way affected by a change in N alone. Therefore, the first step in Zhulovsky produces no direct result in terms of a change in P/R. It is only because of the second step (changing the axial force) that any change in P/R occurs.

Because F/Z in Zhulovsky is actually the product of FB and N, any change in N will produce a reciprocal change in FB for the product to remain constant. On the other hand, it is an operational advantage to have FB and N independently controllable.

SUMMARY OF THE INVENTION

An object of the present invention is to provide a method and apparatus for automatically controlling a drill in a manner which results in higher drill productivity and better utilization of the bit.

Another object of the invention is to provide a method and apparatus for controlling the axial force applied to a drill bit according to the rock specific fracture energy or the work which must be put into the bit to produce a hole.

A further object of the invention is to provide a method and apparatus for controlling the force applied to a drill bit so that axial advance of the bit, per revolution of the bit, is approximately equal to, or does not grossly exceed, the height of the cutting elements on the bit when drilling competent rock. The axial force applied to the bit is automatically decreased as the drill bit passes through less dense material or voids.

Yet another object of the invention is to provide a method and apparatus for controlling a drill by sensing the rate of rotation of the drill bit, the instantaneous axial position of the bit, the pressure of the air being applied to the bit, and indications of the rotational torque required to rotate the bit and the axial force applied to the bit, computing the penetration of the bit per revolution of the bit and the rock specific fracture energy from the sensed values, selecting a desired penetration per revolution according to the calculated rock specific fracture energy, and selectively increasing or decreasing the axial force applied to the bit when the actual penetration per revolution is respectively less than, or greater than the desired penetration per revolution.

Still another object of the invention is to provide a method and apparatus as described above wherein the axial force applied to the bit is decreased, if the pressure of the air supplied to the drill bit, the torque required to rotate the bit, or the axial force applied to the bit, exceeds a predetermined reference level.

A further object of the invention is to provide a method and apparatus as described above wherein vibration of the drill is sensed and the rate of rotation of the drill bit is drastically reduced when the vibration exceeds a reference level.

Other objects, features and advantages of the invention will become obvious from consideration of the following description and the accompanying drawings.

DETAILED DESCRIPTION OF THE INVENTION

Figure 1:
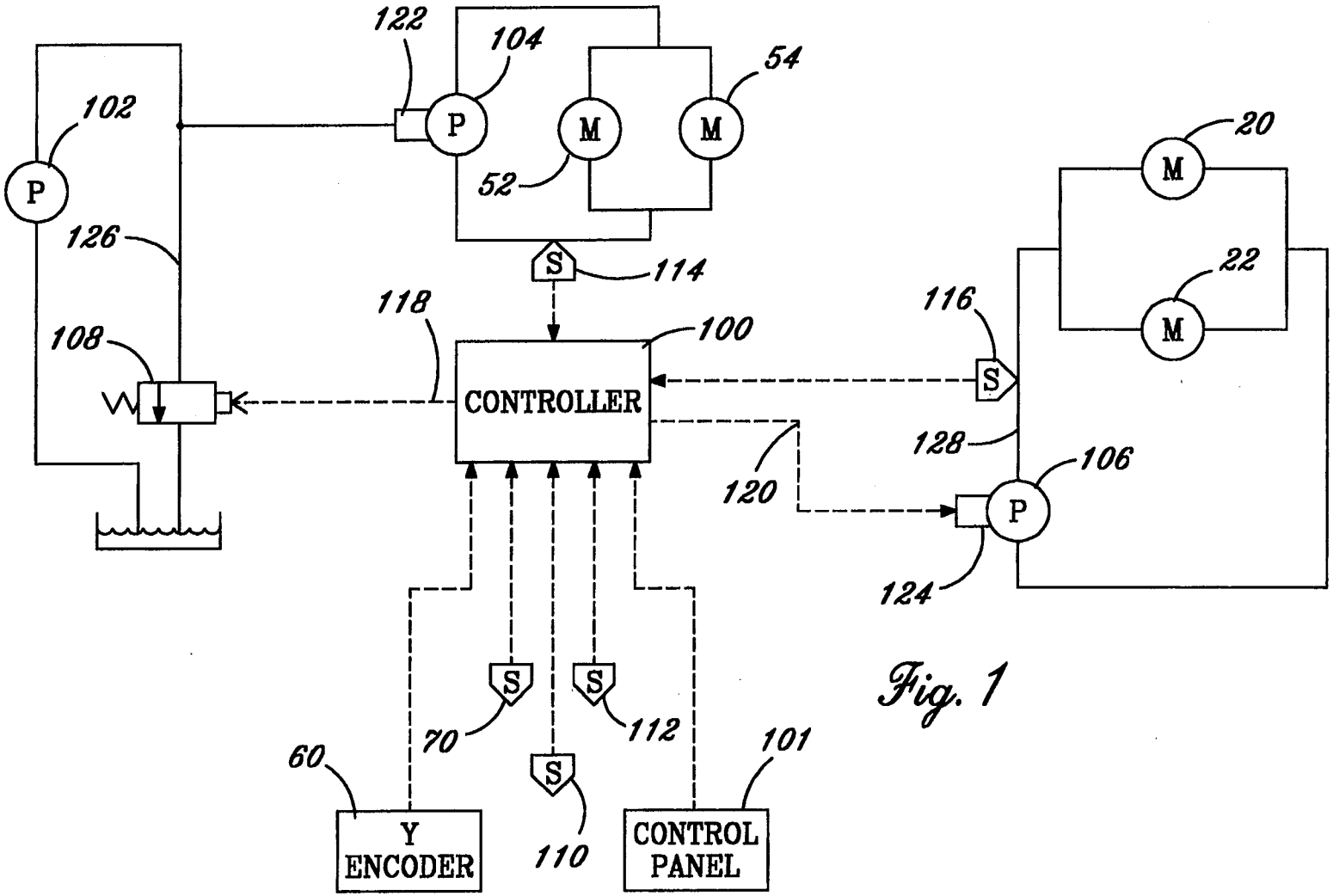
FIG. 1 schematically represents an electro-hydraulic drill control system according to the present invention.

The present invention is suitable for use in drills such as the Model DM-L and DM-H blasthole drills available from the Rotary Drill Division of the Ingersoll-Rand Company and will be described in that environment although it will be evident from the following description that the invention may be used with other drills. A blasthole drill typically includes a tower or mast 10 (FIG. 2) which is supported on a vehicle platform in the manner shown in U.S. Pat. No. 5,201,816. A drill head 12 is mounted for vertical movement within tower 10. The drill head includes a frame or support 14 having guide flanges 16 which engage two front upright members 18 of the tower. Mounted on top of the support 14 are two bi-directional hydraulic rotation motors 20 and 22. These motors drive a head spindle 24 through gearing and the bearings that support the spindle being designed to impart rotational movement to the spindle and also apply a downward thrusting force to the spindle along an axis 26.

The spindle 24 is hollow and hollow pipe 28 is connected to the spindle. At the lower end of the pipe is a drill bit 30 having jet openings (not shown) therein. Air under pressure is applied to an air swivel housing 32 located on support 14. The air under pressure flows through spindle 24 and pipe 28 and out the jet openings in bit 30 to flush the cuttings produced by the drilling process away from the bottom of the drilled hole and up and out of the hole.

Figure 3:
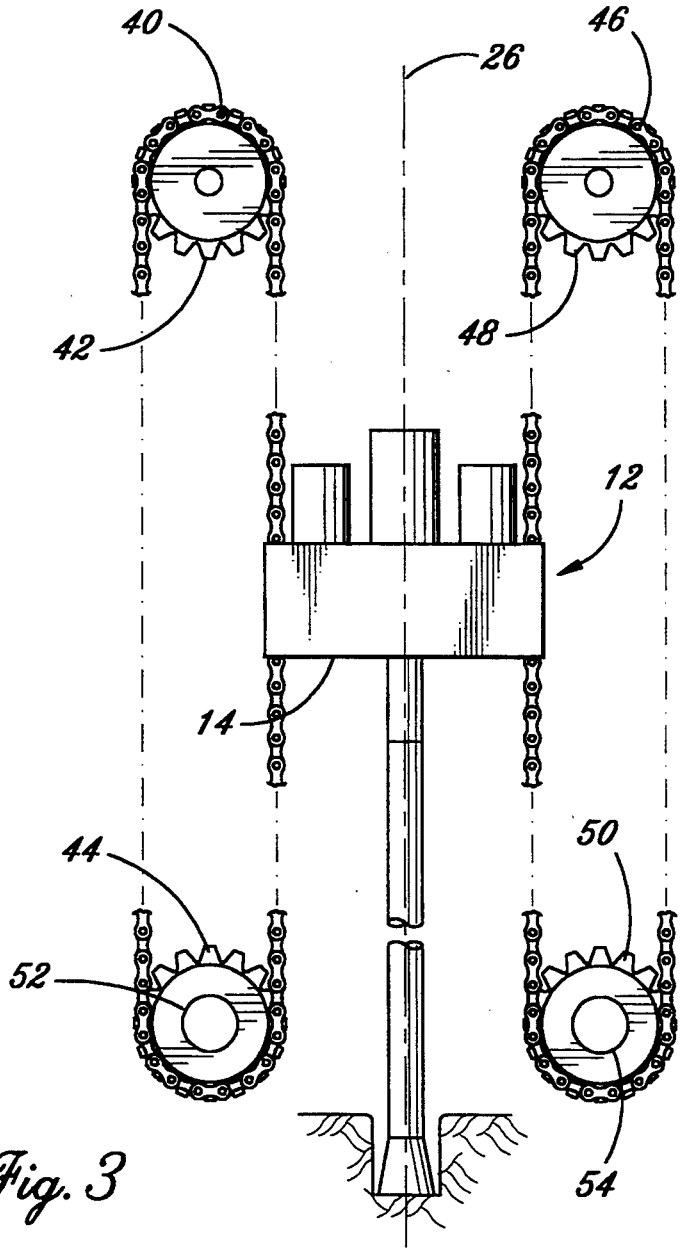
FIG. 3 schematically illustrates a mechanism for raising and lowering a drill bit; and, FIGS. 4A and 4B comprise a flow diagram of a program for controlling axial feed and rotational speed of a drill bit.

The drill head 12 is moved up and down within tower 10 by a chain and sprocket arrangement illustrated in FIG. 3. A first chain 40 is attached to one side of support 14 and looped around a first idler sprocket 42 and a first driven sprocket 44. A second chain 46 is attached to the opposite end of support 14 and looped around a second idler sprocket 48 and a second driven sprocket 50. The idler sprockets 42 and 48 are mounted within the tower near the top thereof and the driven sprockets are mounted within the tower near its bottom. Sprockets 44 and 50 are driven by bi-directional hydraulic feed motors 52 and 54, respectively.

Figure 2:
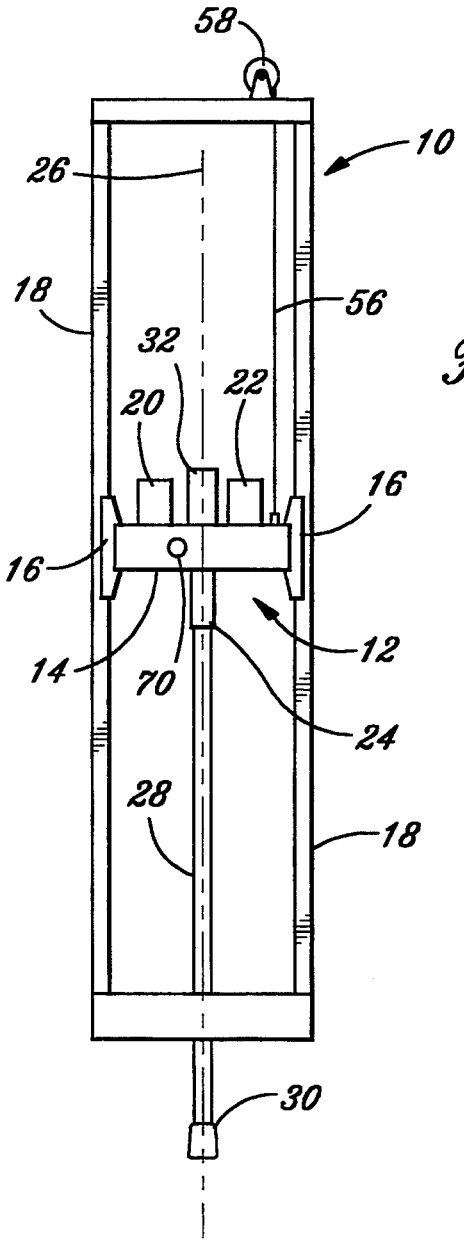
FIG. 2 is an elevation view of a drill tower and drill head.

Motors 52 and 54 are actuated concurrently but drive sprockets 44 and 50 in opposite directions as viewed in FIG. 2. When sprocket 44 is driven clockwise and sprocket 50 is driven counter-clockwise, the drill head 12 is pulled downwardly, thereby increasing the downward axial force or thrust on drill pipe 28 and bit 30. On the other hand, when sprocket 44 is driven counter-clockwise and sprocket 50 is driven clockwise, drill head 12 is moved toward the top of the tower thus raising bit 30 out of a drilled hole.

A cable 56 is wound on a spring-loaded reel 58 and attached at one end to support 14. The reel 58 is mounted at the top of tower 10 and drives an encoder 60 (FIG. 1) which produces an encoded output signal indicating the instantaneous vertical position Y of the bit 30.

A sensor 70, which may be a magnetic sensor, is mounted on support 14 and senses the passage of teeth on a gear (not shown) in the gear train which drives the spindle 24. The frequency of the output signal from sensor 70 is an indication of the rate of rotation N of the bit 30.

FIG. 1 shows a conventional electro-hydraulic system including an auxiliary pump 102, a feed pump 104 for supplying motive fluid to feed motors 52 and 54, a rotation pump 106 for supplying motive fluid to rotation motors 20 and 22, an electro-hydraulic valve 118, a feed pump pressure compensator 122 associated with feed pump 104, and a displacement control 124 for controlling the displacement of rotation pump 106.

FIG. 1 further shows a control system according to the present invention for controlling the rotational speed N of bit 30 and the force FB applied parallel to and coincident with the axis 26 of the bit, the control system including a controller 100, an operator's keyboard or control panel 101, the encoder 60, the sensor 70 and a plurality of further sensors 110, 112, 114 and 116.

Controller 100 may be a conventional microprocessor with memory, including a non-volatile memory capable of retaining information when power is turned off, A/D and D/A converters, and a continuously running clock or timer. The controller receives a digitally encoded signal from encoder 60 indicating the instantaneous vertical position Y of bit 30. The controller also receives analog input signals from sensors 70, 110, 112, 114 and 116 and performs A/D conversion on the sensor signals to produce digital values used in computation. The controller determines if the axial force FB on the bit 30 should be incremented or decremented and also determines if the rotation speed (N) of the bit should be incremented or decremented. Based on these determinations, the controller derives two digital values representing the desired force on the bit and the desired rotational speed of the bit. The derived digital values are set into two output registers within the controller and the contents of the registers are applied through D/A converters in a well-known manner so that analog output signals are developed on output leads 118 and 120 to control the feed pump 104 and rotation pump 106, respectively.

Sensor 110 is a pressure sensor for sensing the air pressure AP applied through pipe 28 to bit 30. Sensor 110 is preferably located at some point in rigid air piping located on the tower.

Sensor 112 is a vibration sensor which may be mounted on the drill head 12. One or more additional vibration sensors may be provided at other locations such as, for example, at or near the bottom of tower 10. The vibration sensor or sensors may be conventional acceleration, displacement, or strain gage sensors such as those used to measure structural loading.

Sensor 114 is a pressure sensor which monitors the pressure on the inlet side of the feed motors 52 and 54 when they are driven in the direction causing downward movement of the drill head 12. For any given drill rig, there is a fixed relationship between the feed pressure applied to the motors 52, 54 and the axial thrust FB applied to the bit hence an electrical output signal produced by sensor 114 provides an indication of the thrust FB.

Sensor 116 is a pressure sensor for monitoring the pressure on the inlet side of rotation motors 20 and 22 when they are driven in the forward or drilling direction. In this regard, even though motors 20 and 22 are reversible, they are driven in the reverse direction only when disconnecting the drill pipes or bit. For any given drill rig, there is a fixed relation between the rotation pressure applied to motors 20, 22 and the torque produced by the motors to rotate the bit hence an electrical output signal produced by sensor 116 provides an indication of the rotational torque RT being applied to the bit.

The feed motors 52, 54 for moving the drill head vertically are connected in a hydraulic circuit in which the motive fluid is pumped by feed pump 104. The pump 104 is provided with a pressure compensator 122 that is responsive to the pressure in a line 126 extending between auxiliary pump 102 and electro-hydraulic valve 108. Controller 100 produces, on lead 118, an analog electrical signal indicating the force FB to be applied to the bit 30. For a fixed voltage signal on lead 118, the valve is controlled to give a certain pressure in the line 126 for the feed pump compensator 122 to hold. The feed pump 104 then provides just that amount of fluid to the feed motors 52, 54 to maintain, but not exceed, that pressure.

Rotation pump 106 pumps the hydraulic fluid for driving the drill rotation motors 20 and 22. Pump 106 is provided with an electro-hydraulic pump displacement control 124 of conventional design. Controller 100 provides an analog output signal over lead 120 to the displacement control, the analog output signal indicating the desired rotation speed N of the bit. For a given magnitude of the signal on lead 120, the displacement control 124 sets the displacement of rotation pump 106 so that the pump provides a fixed flow to motors 20, 22 regardless of whether the rock being drilled is hard or soft. Therefore, the rotation pressure automatically adjusts itself depending on how much torque (RT) is required to rotate the bit at the desired speed.

Figure 4A:
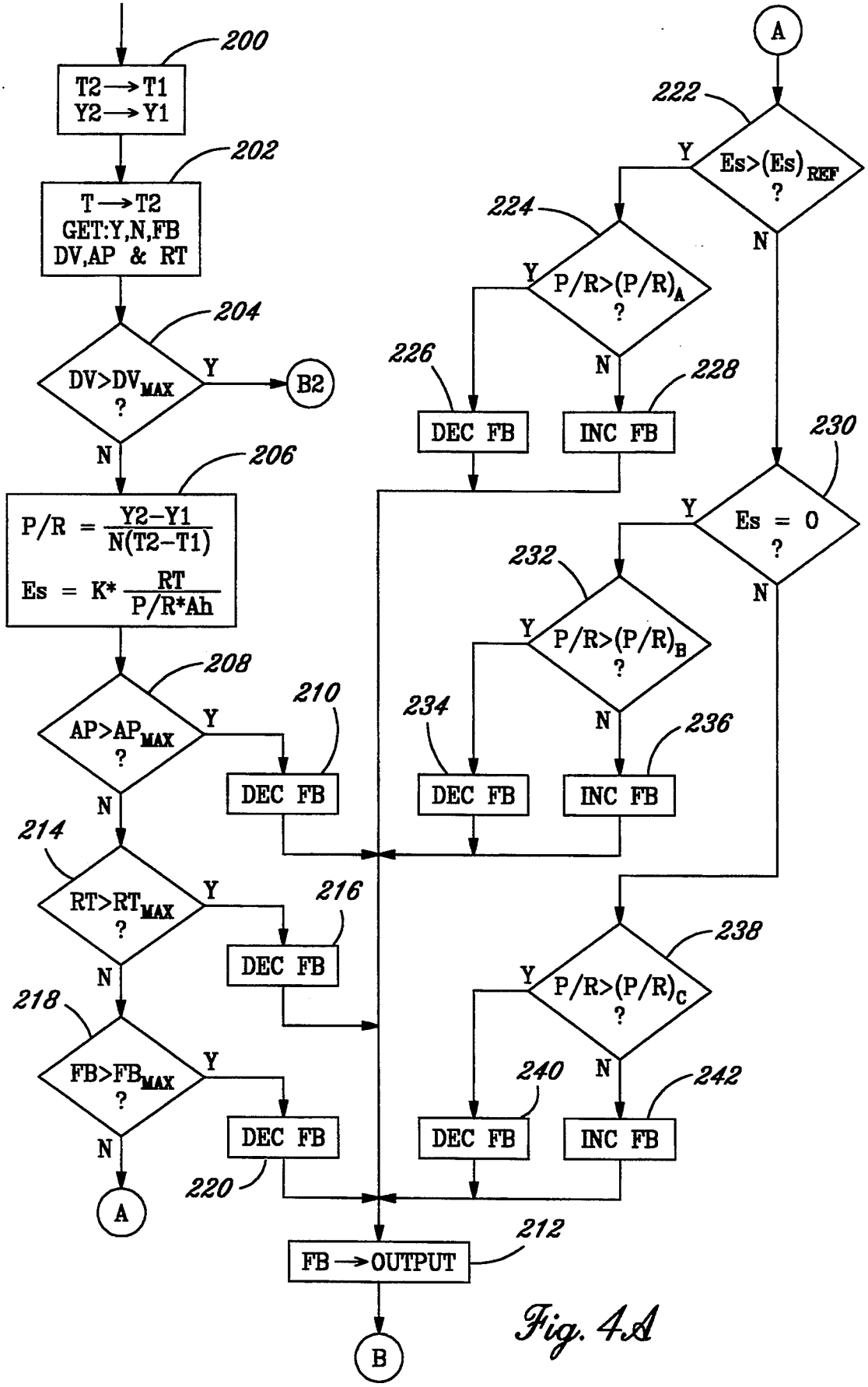
Figure 4B:
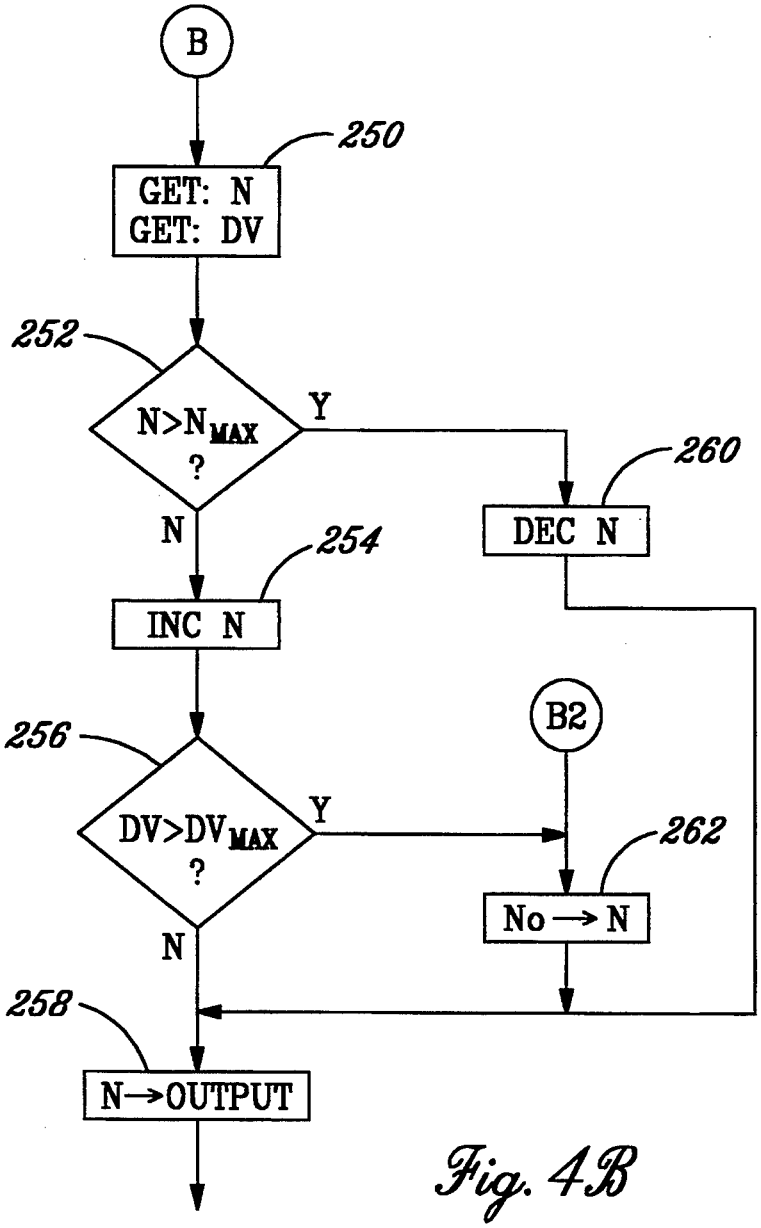

FIGS. 4A and 4B illustrate a program executed by controller 100 to control rotation pump 106 and feed pump 104 in response to the conditions sensed by encoder 60 and sensors 70, 110, 112, 114 and 116. The program is repeatedly executed only during the time an auto/manual control switch (not shown) on control panel 101 is set to the "auto" position by an operator. When the switch is set to the "manual" position, the operator may manually operate control levers to generate electrical signals which are applied over leads, not shown, to valve 108 and displacement control 124 to control feed pump 104 and rotation pump 106.

Two memory locations Y1 and Y2 are used to store indications of the vertical position Y of the bit at two successive sensings of the vertical position. At step 200 a previously sensed value of Y is transferred from Y2 to Y1 and at step 202 the controller senses encoder 60 and stores the current indication of the bit position in Y1.

Two memory locations T1 and T2 are used to store indications of the times at which two successive sensings of the vertical position of the bit occur. Step 200 transfers the time of the previous sensing from T2 to T1. At step 202 the controller senses an internal timer T and loads into T2 the time at which the current sensing of Y takes place.

At step 202 the controller also samples the output signals from sensors 112, 110, 114 and 116 and stores digital indications of the magnitudes of the signals at memory locations DV, AP, FB and RT, respectively. The sensed value of rotational torque is "normalized" prior to storage in RT by subtracting from the sensed value a stored value representing the torque required to rotate the drill bit even though it is not drilling.

The controller derives the rate of rotation N of the bit in a conventional manner by sensing the contents of a register which holds an indication of the rate of rotation of the bit. In this regard, a timer within the controller counts timing pulses during intervals of time elapsing between sensing of successive gear teeth by sensor 70. The contents of the counter are transferred to a register and the counter is reset as each gear tooth is sensed. The register is sensed at step 202 and the value therein is multiplied by an appropriate conversion constant to convert the counter value to an indication of the rotational speed N.

If more than one vibration sensor is provided, all of the sensor output signals are sampled at step 202 and stored at different locations in memory. At step 204, the drill vibration value (or values) is/are compared with a maximum value $DV_{MAX}$. $DV_{MAX}$ may have a different value for each vibration sensor. If none of the sensed drill vibrations is greater than its corresponding $DV_{MAX}$, the program advances to step 206 where the controller calculates P/R, the advance of bit 30 per revolution. P/R is determined by subtracting the last previous bit position sensed from the current position sensed when step 202 was last executed to determine the change in vertical bit position. The difference between T2 and T1, when multiplied by the rotational speed N of the bit yields a value representing the angular movement of the bit during the interval of time which elapsed between the two sensings of the vertical position. Dividing the change in vertical bit position by the angular movement of the bit as it is moved between the two positions yields P/R, the penetration of the bit per revolution.

At step 206 the controller also calculates the rock specific fracture energy (Es) which is a measure of the work put into the bit to drill the hole, and an indication of the density or hardness of the material through which the bit is passing. Es is calculated by dividing RT by the product of P/R times the area of the hole Ah being drilled, and multiplying the result by a constant K. Different values of Ah corresponding to different diameters of drill bits may be stored in memory and the correct value may be selected from the control panel 101 by the operator prior to initiation of a drilling operation.

The air pressure AP sensed in pipe 28 is then compared (step 208) with a value $AP_{MAX}$ stored in nonvolatile memory. The pressurized air in pipe 28 exits through jets in bit 30 and conveys drilled rock chips and dust away from the bit and upwardly and out of the drilled hole. If the bit is advanced too fast the pressurized air cannot convey the chips and dust away from the bit and the chips and dust accumulate around the bit until the flow of pressurized air is completely blocked. As the accumulation begins, the pressure in pipe 28 begins to rise. $AP_{MAX}$ is chosen to be greater than the pressure normally present in pipe 28 if the chips and dust are being freely conveyed out of the drilled hole but considerably less than the pressure that would be present in pipe 28 when the chips and dust completely clog the hole. Thus, step 208 senses for the onset of clogging. If step 208 determines that AP is greater than $AP_{MAX}$, FB is decreased at step 210 and at step 212 the decreased value of FB is set into an output register to decrease the magnitude of the signal applied over lead 118 to valve 108. As a result, the valve opens somewhat so that the pressure in line 126 decreases. The feed pump pressure compensator then responds to the reduced pressure in line 126 and the flow from feed pump 104 to the fluid motors 52, 54 is correspondingly controlled to maintain a decreased pressure. Because the feed pressure is decreased, the axial force applied to the bit 30 decreases. The drill bit crushes away less rock thus permitting the accumulation of chips and dust to be cleared by the air being forced out of the drill bit.

If the comparison at step 208 shows that AP is not greater than $AP_{MAX}$, step 214 is executed to compare RT with $RT_{MAX}$. $RT_{MAX}$ is a value stored in non-volatile memory and represents, for a specific drill, the maximum rotational torque which should be applied to rotate the bit. RT is primarily a function of P/R and P/R is only a function of FB. If RT is greater than $RT_{MAX}$, FB is decreased (step 216) and set into the output register (step 212) to cause a decrease in the axial force on the bit as previously described. The displacement control 124 sets rotation pump 106 to produce a fixed flow for a given magnitude of signal on lead 120. The rotation pressure applied to motors 20, 22 varies depending on the torque, RT, required to rotate the bit. A decrease in FB will cause RT to decrease and that will cause a decrease in the pressure in line 128, which is sensed as an indication of RT. So, the next time the program executes step 202, a lower value of RT will be sensed.

If the comparison at step 214 shows that RT is not greater than $RT_{MAX}$, step 218 is executed to compare FB with $FB_{MAX}$. $FB_{MAX}$ is a value stored in non-volatile memory and represents, for a specific drill, the maximum axial force which may be applied to the drill bit, If the comparison at step 218 determines that FB is greater than $FB_{MAX}$, then FB is decreased at step 220 and transferred to the output register (step 212) to decrease the axial force applied to the bit, as described above.

If the comparison at step 218 determines that FB is not greater than $FB_{MAX}$, step 222 is executed to compare the value Es, computed at stp 206 with $(Es_{ref})$. The value of $(Es)_{ref}$ is chosen according to the density or hardness of the material to be drilled. For example, $(Es)_{ref}$ may be set to a value somewhat less than the Es for competent rock.

If Es is greater than $(Es)_{ref}$ then at step 224 the value of P/R computed at step 206 is compared with a value $(P/R)_A$. $(P/R)_A$ is a value related to the height of the cutting elements on the bit and is chosen to be approximately equal to, or not grossly exceeding the height of the cutting elements. If P/R is greater than $(P/R)_A$ then FB is decreased at step 226 but if P/R is not greater than $(P/R)_A$ then FB is increased at step 228. The increased or decreased value of FB is then loaded into an output register to generate a signal for controlling valve 108 as previously described.

If the comparison at step 222 shows that Es is not greater than $(ES)_{ref}$ then Es is tested at step 230 to determine if it is zero. If Es is not equal to zero then at step 232 P/R is compared with $(P/R)_B$. $(P/R)_B$ is a fixed value chosen to be larger than the height of the cutting elements of bit 30 so as to allow faster drilling speeds in soft material. If the comparison at step 232 shows that P/R is greater than $(P/R)_B$ then FB is decremented at step 234 before being transferred to the output register at step 212. On the other hand, if P/R is not greater than $(P/R)_B$ then FB is incremented at step 236 before being transferred to the output register.

If the test at step 230 shows that Es is zero then the drill bit is passing through a void and axial advance of the drill bit should be increased, but not to the extent that the bit will be jammed with too much force into a rock formation which may be underneath the void. At step 238 P/R is compared with $(P/R)_C$, a stored constant value representing a safe penetration of the bit, per revolution, through voids. If the comparison shows that P/R is greater than $(P/R)_C$ then FB is decremented (step 240) and transferred to the output register (step 212) to cause a reduction in P/R of the bit. On the other hand, if P/R is not greater than $(P/R)_C$ then FB is incremented (step 242) before being transferred to the output register to cause an increase in the P/R of the bit.

The controller 100 controls the rotation speed (N) of bit 30 independently of the P/R of the bit. Generally speaking, N is controlled to be equal to $N_{MAX}$ where $N_{MAX}$ is the maximum speed at which a particular drill should be operated. However, if speed N causes drill vibration DV with a root-mean-square value exceeding $DV_{MAX}$, the maximum allowable vibration, then the rotation speed is drastically reduced. This simulates the manual control where an operator merely reduces the drill speed at the onset of excessive vibration. Typically, the rotation speed may be reduced by 50% but this may vary over a wide range.

FIG. 4B illustrates the portion of the program executed by controller 100 to control the rotational speed N of the bit 30. At step 250, which may follow step 212. The controller obtains the current values of N and DV in the same manner as described with respect to step 202. Step 252 compares N with $N_{MAX}$ and if N is not greater than $N_{MAX}$ N is incremented at step 254. DV is then compared with $DV_{MAX}$ (step 256) and if DV is not greater than $DV_{MAX}$ the incremented value of N is entered into an output register (step 258) to set (increase) the magnitude of the signal applied over lead 120 to the rotation pump displacement control 124. This causes the rotation pump 106 to increase the flow to rotation motors 20, 22 thus increasing the rotation speed of the bit 30.

If the comparison at step 252 determines that N is greater than $N_{MAX}$ then N is decremented at step 260 before being loaded into the output register (step 258) to decrease the magnitude of the signal applied to the displacement control 124.

If the comparison of DV with $DV_{MAX}$ at either step 204 or step 256 determines that DV is greater than $DV_{MAX}$ then N is reset at step 262 to some value $N_0$ low enough to insure that DV will drop below $DV_{MAX}$. The new value of N is then transferred to an output register (step 258) to reduce considerably the magnitude of the signal on lead 120 thereby causing the rotation motors 20, 22 to rotate the bit 30 at a much lower speed.

Although FIG. 4A shows control of the axial feed rate according to only three ranges of Es (steps 222 and 230) it will be understood that the algorithm may be expanded to differentiate between more values of Es with additional values of $P/R_X$ being used to obtain different bit feed rates.

From the foregoing description it is seen that the present invention provides a novel method of controlling a drill by determining (step 206) the actual penetration of the drill bit per revolution of the bit, determining the rock specific fracture energy Es (step 206), based on the magnitude of Es (steps 222, 230) selecting a desired penetration of the bit per revolution $(P/R)_A$, $(P/R)_B$, $(P/R)_C$ and selectively increasing and decreasing the axial force (steps 226, 228, 234, 236, 240 and 242) applied to the bit in order to maintain the actual penetration of the bit per revolution of the bit approximately equal to the desired penetration of the bit per revolution.

While the invention has been described in conjunction with a specific drill, it may be used in the control of drills of various types. For example, the invention may be used to control drills employing a piston-cylinder arrangement rather than a chain and hydraulic feed motors for vertically moving the drill head. Also, the invention is applicable to drills having only one axial feed motor and/or one rotation motor. The method of the invention may also be practiced with drills having an electric motor or motors as the feed and/or rotation motors.

I claim:

1. A method of controlling a drill having a bit movable along an axis and rotatable about said axis to drill a hole in rock material, said method comprising:

applying a force to said bit along said axis while applying rotational torque to said bit;

determining the actual penetration of said bit into said rock material per revolution of said bit;

sensing the applied rotational torque;

determining the rock specific fracture energy from the sensed rotational torque and the measured penetration of said bit per revolution of said bit;

selecting a desired penetration of said bit into said rock material per revolution of said bit, said selection being based on the magnitude of the determined rock specific fracture energy; and, selectively increasing and decreasing the force applied to said bit along said axis to maintain the actual penetration of said bit per revolution of said bit approximately equal to said desired penetration of said bit per revolution of said bit.

2. A method as claimed in claim 1 and further comprising the steps of:

sensing the axial force applied to said bit; and, decreasing the applied axial force when the sensed axial force exceeds a reference level.

3. A method as claimed in claim 1 and further comprising the step of decreasing the axial force applied to said bit when the sensed applied rotational torque exceeds a reference level.

4. A method as claimed in claim 1 for controlling a drill wherein air under pressure is supplied to and through said bit to remove drilled rock material, said method further comprising:

sensing the pressure of the air supplied to the bit; and, decreasing the axial force applied to the bit when the sensed pressure exceeds a reference level.

5. A method as claimed in claim 1 wherein:

when the determined rock specific fracture energy indicates competent rock, the selected desired penetration of the bit per revolution of the bit is approximately equal to the height of cutting elements on the bit.

6. A method as claimed in claim 1 wherein the step of selecting a desired penetration of the bit per revolution of the bit comprises selecting a first, second or third rate of penetration depending on whether the determined rock specific fracture energy has a value indicating the drill bit is passing through competent rock, a less dense material, or a void.

7. A method as claimed in claim 1 and further comprising:

sensing the rotational speed of said bit;

increasing the rotational speed of said bit when the sensed rotational speed is no greater than a reference speed; and decreasing the rotational speed of said bit when the sensed rotational speed is greater than said reference speed.

8. A method as claimed in claim 7 and further comprising:

sensing vibration of said drill at at least one point thereon; and, reducing the rotational speed of said bit considerably when the sensed vibration exceeds a reference level.

9. Apparatus for controlling a drill having a bit movable along an axis and rotatable about said axis to drill a hole in rock material, said apparatus comprising:

means for applying a rotational torque to said bit to rotate it;

means for applying a force to said bit along said axis;

means for determining the actual penetration of said bit into said rock material per revolution of said bit;

means for sensing the applied rotational torque;

means for determining the rock specific fracture energy from the sensed rotational torque and the measured penetration of said bit per revolution of said bit;

selecting means responsive to the magnitude of the determined rock specific fracture energy for selecting a desired penetration of said bit into said rock material per revolution of said bit; and, means for selectively increasing and decreasing the force applied to said bit along said axis to maintain the actual penetration of said bit per revolution of said bit approximately equal to said desired penetration of said bit per revolution of said bit.

* * * * *